US009046303B2

(12) United States Patent
Yagi

(10) Patent No.: US 9,046,303 B2
(45) Date of Patent: Jun. 2, 2015

(54) FREEZE-DRYING METHOD AND APPARATUS FOR THE SAME

(71) Applicant: Shunichi Yagi, Shizuoka (JP)

(72) Inventor: Shunichi Yagi, Shizuoka (JP)

(73) Assignees: SANWA ENGINEERING CO., LTD., Gunma (JP); FUTAMI SEIKA CO., LTD., Hokkaido (JP)

( * ) Notice: Subject to any disclaimer, the term of this patent is extended or adjusted under 35 U.S.C. 154(b) by 235 days.

(21) Appl. No.: 13/689,637

(22) Filed: Nov. 29, 2012

(65) Prior Publication Data

US 2013/0326899 A1 Dec. 12, 2013

(30) Foreign Application Priority Data

Nov. 30, 2011 (JP) ..... 2011-261709

(51) Int. Cl.
*F26B 5/06* (2006.01)
*F26B 3/30* (2006.01)

(52) U.S. Cl.
CPC .... *F26B 3/30* (2013.01); *F26B 5/06* (2013.01)

(58) Field of Classification Search
CPC ..... F26B 3/00; F26B 5/00; F26B 5/06; A23B 3/40; A23B 7/02; A23B 4/03; A23B 4/031; F25B 3/02; F25B 3/00; F25B 5/00; F25B 5/04
USPC ..... 34/266, 268, 269, 284, 285, 286, 92; 219/685, 686, 709, 751; 62/63, 67, 71, 62/476, 533
See application file for complete search history.

(56) References Cited

U.S. PATENT DOCUMENTS

| | | | | | |
|---|---|---|---|---|---|
| 2,668,364 | A | * | 2/1954 | Colton | 34/266 |
| 3,078,586 | A | * | 2/1963 | Philibert | 34/287 |
| 3,218,727 | A | * | 11/1965 | Lind | 34/287 |
| 3,245,152 | A | * | 4/1966 | Natelson et al. | 34/92 |
| 3,293,772 | A | * | 12/1966 | Gottfried et al. | 34/92 |
| 3,315,480 | A | * | 4/1967 | Rich | 62/63 |
| 3,382,584 | A | * | 5/1968 | Blake et al. | 34/292 |
| 3,616,542 | A | * | 11/1971 | Rader | 34/287 |
| 4,204,336 | A | * | 5/1980 | Le Viet | 34/297 |
| 4,520,574 | A | * | 6/1985 | Sugisawa et al. | 34/289 |
| 4,590,684 | A | * | 5/1986 | Arsem | 34/284 |
| 5,560,122 | A | * | 10/1996 | Bauer et al. | 34/268 |
| 5,822,882 | A | * | 10/1998 | Anger | 34/296 |
| 5,859,412 | A | * | 1/1999 | Yagi | 219/704 |

(Continued)

FOREIGN PATENT DOCUMENTS

| | | | |
|---|---|---|---|
| EP | 2278002 | A1 * | 1/2011 |
| JP | 2007-167014 | A | 7/2007 |

(Continued)

*Primary Examiner* — Steve M Gravini
(74) *Attorney, Agent, or Firm* — Hedman & Costigan, P.C.; James V. Costigan; Kathleen A. Costigan

(57) ABSTRACT

A freeze-drying method by a far infrared heater including the steps of: mounting the frozen objects to be dried prior to heating in the containers in which an absorption power of the radiant heat from the far infrared heater and a thermal conductivity are high, respectively; mounting the said objects which are contained in the containers into the reduced pressure tank under an atmospheric pressure; heating the containers by the radiant heat from the far infrared heater disposed in the reduced pressure tank; and sublimating the frozen water contents of the objects in a reduced pressure state where sublimation of the objects occurs in the reduced pressure tank.

5 Claims, 5 Drawing Sheets

(56) References Cited

U.S. PATENT DOCUMENTS

| | | | | |
|---|---|---|---|---|
| 6,025,580 | A * | 2/2000 | Yagi | 219/685 |
| 6,584,782 | B2 * | 7/2003 | Leuenberger et al. | 62/64 |
| 7,441,344 | B1 * | 10/2008 | Savarese | 34/268 |
| 8,507,016 | B2 * | 8/2013 | Yagi | 424/744 |
| 2002/0088137 | A1 * | 7/2002 | Savarese | 34/266 |
| 2002/0178605 | A1 * | 12/2002 | Aoki | 34/92 |
| 2008/0229609 | A1 * | 9/2008 | Bronshtein | 34/287 |
| 2013/0326899 | A1 * | 12/2013 | Yagi | 34/266 |
| 2014/0215845 | A1 * | 8/2014 | Corver | 34/284 |

FOREIGN PATENT DOCUMENTS

| | | | |
|---|---|---|---|
| JP | 2013113532 | A * | 6/2013 |
| WO | WO 2011082196 | A2 * | 7/2011 |
| WO | WO 2012056184 | * | 5/2012 |

* cited by examiner

FREEZE-DRYING METHOD AND APPARATUS FOR THE SAME

BACKGROUND OF THE INVENTION

1. Field of the Invention

The present invention relates to a freeze-drying apparatus which is effective for all fields in which freeze-drying has heretofore been used, for example, a food field of vegetables, fishes and shellfishes, fruits and processed foodstuffs, a pharmaceutical field of medicines and the like, and a cosmetic field and which can efficiently freeze and dry various objects to be dried in a short time.

2. Background Art

In conventional freeze-drying, to heat objects to be dried, heaters have usually been arranged for individual containers in which the objects to be dried are mounted, and the containers in which the objects to be dried are mounted have usually individually and directly been heated.

To arrange the heaters for the above individual containers has been a main cause for increase of a price of a freeze-drying apparatus. The present inventor has investigated a heating technology by far infrared rays in a reduced pressure tank over a long period of time, has invented a heating apparatus to containers in which objects to be dried are mounted, by far infrared rays under a reduced pressure and has filed an application for the invention.

In the conventional freeze-drying, heating to containers by radiant heat has not usually been effective under a reduced pressure, and hence there is usually used a method of directly applying heaters to the individual containers mounted on respective stages, to directly heat the containers, thereby causing sublimation in objects to be dried, by heat conduction. In a conventional freeze-drying apparatus, the heaters have to be prepared for the individual containers of the objects to be dried, and the very complicated expensive apparatus is forced to be formed. Moreover, only bottom surfaces of the containers of the objects to be dried are basically heated, and hence as a drying time, a very long time of, for example, 24 hours or 36 hours is required. Furthermore, since the objects to be dried are heated only from the bottom surfaces of the containers, a thickness of each of the objects to be dried is limited to about 7 mm at maximum, which has imposed a limit on product development.

As a conventional freeze-drying method of foods, there is disclosed a freeze-drying method characterized by freezing a fish-paste product containing ground fish meat, setting a pressure at drying to 0.6 to 0.65 Torr for the fish-paste product, performing first sublimation of drying the product in an environment at 35 to 45° C. for 1.5 to 2.5 hours, performing second sublimation of drying the product in an environment at 70 to 80° C. for 14 to 16 hours, and then performing third sublimation of drying the product in an environment at 45 to 55° C. for 23 to 25 hours (Jpn. Pat. Appln. Publication No. 2007-167014).

SUMMARY OF THE INVENTION

According to the above conventional invention of a freeze-drying method, in heating to containers in which objects to be dried are mounted, heating unevenness occurs in the object to be dried which is positioned on a heater and the object to be dried which is positioned on a space between the heaters. Moreover, there is also a drawback that the objects are heated only from the bottom surfaces of the containers and are accordingly forced to be dried for a long drying time of 24 hours or more. Furthermore, a thickness of each of the objects to be dried is limited to a thickness smaller than about 7 mm, and it has been difficult to sublimate and dry a substance having a large thickness.

In view of the above respect, an object of the present invention is to provide a freeze-drying apparatus which can efficiently dry objects to be dried by freeze-drying in a short time and can dry even the objects to be dried each having a thickness of 7 mm or more.

A freeze-drying apparatus according to the present invention includes a reduced pressure tank in which a far infrared heater is disposed along a sidewall, or the sidewall and a ceiling; a container carrier which conveys a plurality of containers to contain mounted objects to be dried into the reduced pressure tank, and supports the containers in a drying step; the containers having a high absorption power of radiant heat and mounted via a space in multistage of the container carrier; the frozen objects to be dried which are contained in the containers; a tray support member of the container carrier in which the respective containers containing the frozen objects to be dried are vertically arranged via the space on multistage so that the containers are evenly irradiated with heat radiated from the far infrared heater and in which the containers mounted on the respective stages are tilted at the same angle or at such angles that the containers are evenly irradiated with the radiated heat; and inside the reduced pressure tank, a control section including a heating temperature detecting section and a pressure detecting section is arranged in order to sublimate the objects to be dried in the reduced pressure state where the sublimation of the objects to be dried occurs in the reduced pressure tank; and outside the reduced pressure tank, a heating temperature control section of the far infrared heater to the containers and a pressure control section which controls the pressure inside the tank are arranged.

The freeze-drying apparatus according to claim 6 is characterized in that respective outer surfaces of the containers which are made of a metal and in which the objects to be dried are mounted or respective outer surfaces of containers with drop lids as the containers with the lids which keep atmosphere in the reduced pressure tank are baking-finished with a fluoric resin or a silicon resin in black or a color close to the black.

The freeze-drying apparatus according to claim 6 or 7 is characterized in that a metal material of the metal containers in which the objects to be dried are mounted and the lids for the containers is an aluminum plate or a stainless steel plate.

The freeze-drying apparatus according to claim 6, claim 7 or claim 8 is characterized in that shelves forming the plurality of stages on which sets of the metal containers to contain the mounted objects to be dried and the lids for the containers are mounted are made of stainless steel, the shelves of the stages are arranged via a space of 80 mm or more, and each of the stages includes a frame which is provided with a gradient of 10 degrees or more and which supports the containers containing the mounted objects to be dried.

The freeze-drying apparatus according to claim 6, claim 7, claim 8 or claim 9 is characterized in that inside the reduced pressure tank, the far infrared heater is disposed along the sidewall, or the sidewall and the ceiling, a temperature detector finished in the same black or the same color close to the black as a color of each of the metal containers to contain the mounted objects to be dried is disposed in a portion corresponding to a distance between the far infrared heater and the vicinity of the center of each of the containers to contain the mounted objects to be dried, and means for detecting a heating temperature by the far infrared heater to the outer surface of each of the containers containing the mounted objects to be dried is disposed; further, inside the reduced pressure tank, a pressure detecting means including a pressure sensor is disposed in order to detect a pressure value in the tank; and outside the reduced pressure tank, a temperature controller of the far infrared heater, a pressure gauge, a pressure regulating valve, a pressure controller, a return pressure valve and a vacuum pump are arranged, connecting to one another via a metal pipe or a resin pipe.

Heretofore, a freeze-drying apparatus has been very expensive, and there has been a disadvantage that the number of companies which employ the apparatus is limited. Moreover, the conventional freeze-drying apparatus requires a very long drying time, and hence the apparatus needs to be large to acquire a sufficient production amount. The present invention has the constitutions described in the above claims, and hence an inexpensive freeze-drying apparatus having an excellent performance can be provided. Therefore, a demand for the apparatus can be expanded also to districts having objects to be dried all over the world. Moreover, a thickness of each of the objects to be dried which can be frozen and dried is increased to be twice or more as compared with a conventional technology, and the present invention can contribute to a broad range of product development. In the conventional freeze-drying apparatus, an apparatus price is so high that it has been difficult to utilize the apparatus in developing countries. However, the apparatus of the present invention can be increasingly utilized in many districts in the world, and can contribute to economic development of each district, owing to a production time (the production amount), inexpensiveness, and simple maintenance properties of the apparatus.

As a specific effect, according to the present invention, there are provided a freeze-drying apparatus which can efficiently freeze-dry objects to be dried in a comparatively short time, and can dry even objects to be frozen and dried each having a thickness of 7 mm.

In the present invention, it is not necessary to form a complicated structure in which respective containers of the objects to be dried are directly brought into contact with heaters. Therefore, an apparatus structure of the present invention is very simple, and an apparatus price is remarkably low. Moreover, in the present invention, the containers containing the mounted objects to be dried can be heated from bottom surfaces of the containers, and can similarly be heated also from lid surfaces (the upper surfaces). Consequently, a drying time can be shortened to be around ten hours. Furthermore, a thickness of each of the objects to be dried can also be increased to about 20 to 30 mm. In consequence, the present invention can contribute to a very broad range of product development.

Figure 1:
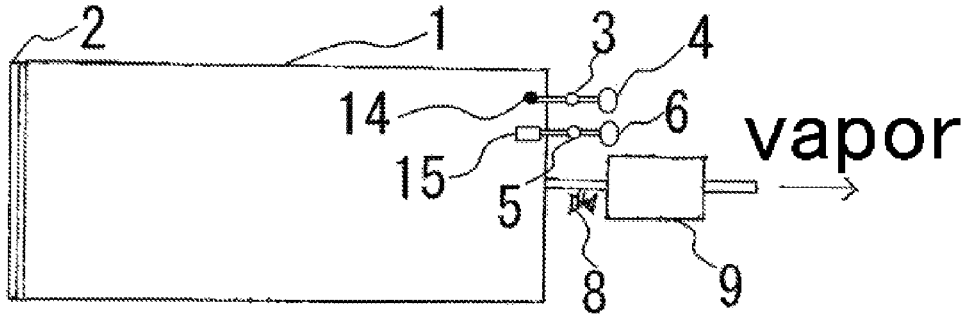
FIG. 1 is a schematic explanatory view showing a reduced pressure tank, a vacuum pump, and temperature and pressure control sections.
Figure 2:
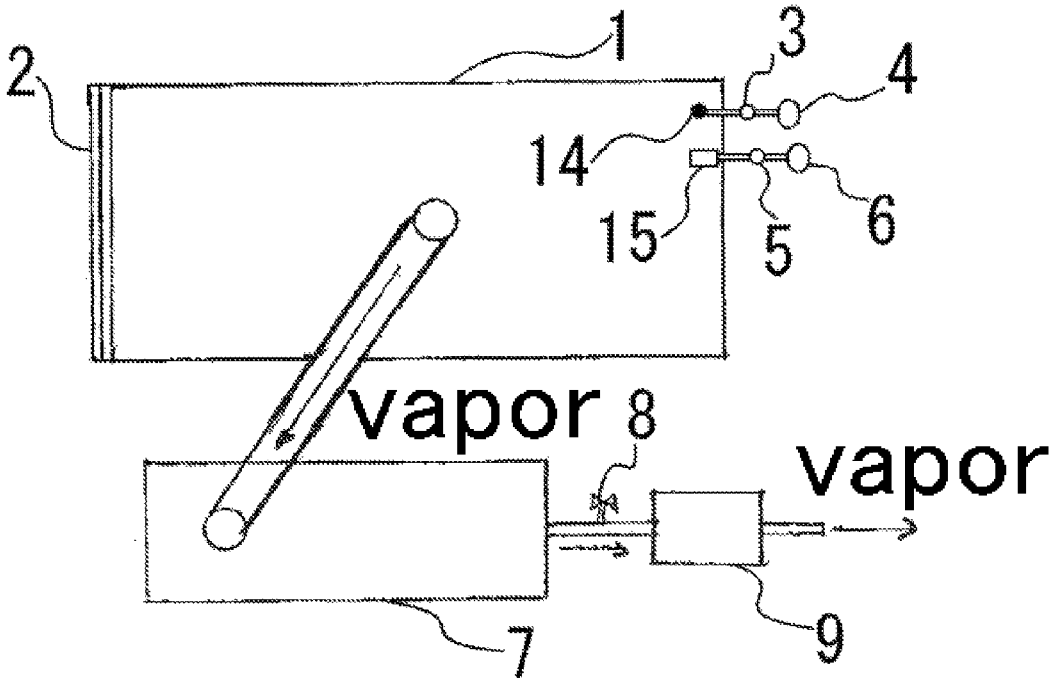
FIG. 2 is a schematic explanatory view showing a case where the vacuum pump is disposed in the reduced pressure tank via a cold trap.

A freeze-drying apparatus by a far infrared heater according to the present invention is based on a scientific fact that far infrared rays are radiated well even under a reduced pressure and that heat is absorbed well by a substance of black or a color close to the black. Therefore, containers with lids in which objects to be dried are mounted are finished in the black as a color having a high absorption power of the far infrared rays or the color close to the black. The objects to be dried which are mounted in the containers are brought into contact with bottom surfaces of the containers and lid surfaces, and heat radiated by the far infrared heater disposed along a sidewall which is an inner wall surface of a reduced pressure tank, or the sidewall and a ceiling is absorbed by the mounted containers and the lids. The objects to be dried evenly cause sublimation by the heat conducted from the containers and the lids to the objects to be dried, and are efficiently dried.

The containers and lids of the objects to be dried are made of aluminum or stainless steel, and coated with a substance having a high far infrared ray absorption power, by performing baking-finish with, for example, a resin such as a fluoric resin or a silicon resin as a material hygienically suitable for foods, cosmetics or the like, which is a simple method. The heat radiated from the far infrared heater is absorbed by outer surfaces of the containers in which the objects to be dried are mounted, and lid outer surfaces of the containers. Next, the heat is efficiently conducted to the objects to be dried, and water contents frozen in the objects to be dried cause sublimation, so that the objects are dried.

Therefore, it is not necessary to employ a complicated difficult structure in which the respective containers of the objects to be dried are brought into contact with the heater. Therefore, an apparatus structure is very simple, and an apparatus price is also remarkably low. Moreover, as to a drying time in the present invention, the objects to be dried can evenly be heated not only from the bottom surfaces of the containers in which the objects to be dried are mounted but also from the lid surfaces (the upper surfaces), and hence the drying time can be shortened to about ten hours. Furthermore, a thickness of each object to be dried can also be increased to about 20 to 30 mm, which contributes to a very broad range of product development.

In temperature control, an allowable temperature varies depending on the objects to be dried. Therefore, a metal dummy sensor finished in the black or the color close to the black is disposed in the reduced pressure tank, and a temperature of the heat absorbed by the containers is detected by the sensor, to control a heating temperature.

That is, the present invention is a heating apparatus for objects to be dried in freeze-drying. There is provided a freeze-drying method by a far infrared heater, that can mount frozen objects to be dried or unfrozen objects to be dried in containers having a high absorption power of radiant heat from the far infrared heater and having a suitable thermal conductivity, or mount for the objects to be dried in containers with lids which keep atmosphere in a reduced pressure tank; mount the frozen objects to be dried or the unfrozen objects to be dried which are mounted in the containers, into the reduced pressure tank under an atmospheric pressure; and sublimate the objects to be dried in a reduced pressure state where the sublimation of the objects to be dried takes place in the reduced pressure tank through heating and heat conduction to the containers or the containers with the lids by the radiant heat of the far infrared heater disposed in the reduced pressure tank.

The apparatus in the present invention is characterized in that the containers or the containers with the lids having a high absorption power of the radiant heat to the containers by the far infrared heater and a suitable thermal conductivity form films coating of black or a color close to the black on outer surfaces of the containers made of a metal, or the outer surfaces of the containers made of the metal and lid surfaces of the containers made of the metal respectively, and conduct heat to the objects to be dried from both sides of each of the containers and each of the lids.

The apparatus in the present invention is characterized in that the objects to be dried which are mounted in the containers or the containers with the lids having the high absorption power of the radiant heat from the far infrared heater and having the suitable thermal conductivity are frozen outside the reduced pressure tank before the objects to be dried are mounted into the reduced pressure tank, or the objects to be dried in an unfrozen state are mounted into the reduced pressure tank, pressure reduction is advanced, and the objects to be dried are frozen by evaporation latent heat of evaporation of water contents of the objects to be dried themselves.

The freeze-drying apparatus by the far infrared heater is characterized in that prior to the heating of the objects to be dried which are mounted in the containers or the containers with the lids having the high absorption power of the radiant heat from the far infrared heater and having the suitable thermal conductivity in the reduced pressure tank, pressure reduction is advanced to a pressure which is not more than a pressure under which a boiling point of water becomes zero degree or lower, to freeze the surfaces of the objects to be dried by evaporation latent heat and sublimation latent heat generated by evaporation of water contents and sublimation of ices which occur in the objects to be dried, and then center of the objects to be dried are also frozen by heat conduction from the containers or the containers with the lids.

The freeze-drying apparatus of the current invention is characterized in that as processing prior to the mounting of the objects to be dried in the containers, the objects to be dried are subjected to a pre-treatment such as cutting, slicing or grinding so that the surfaces of the objects to be dried noticeably come in contact with the inner surfaces of the containers including the lids.

DESCRIPTION OF THE PREFERRED EMBODIMENTS

An outline of a freeze-drying apparatus of the present invention will be described with reference to the drawings.

Figure 3:
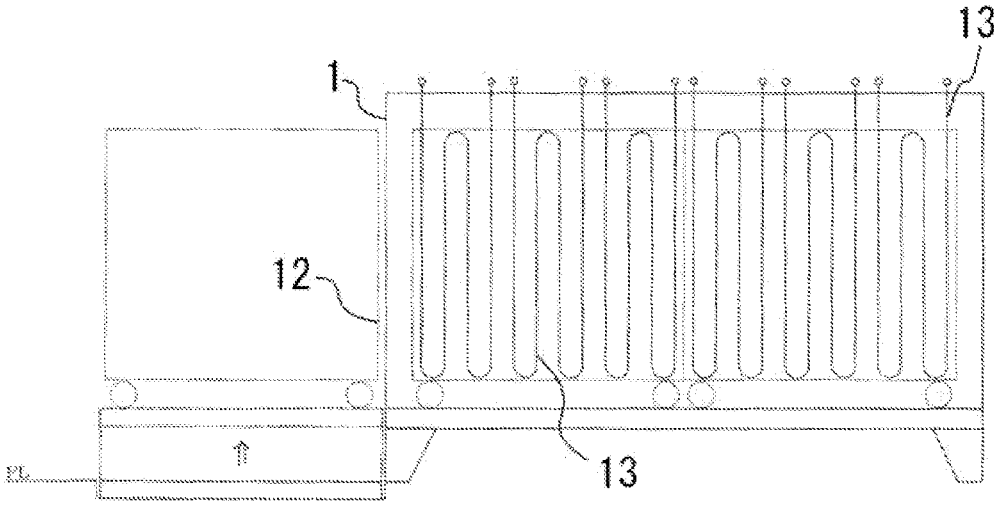
FIG. 3 is a front view showing an inner sidewall of the reduced pressure tank, and a container carrier.
Figure 4:
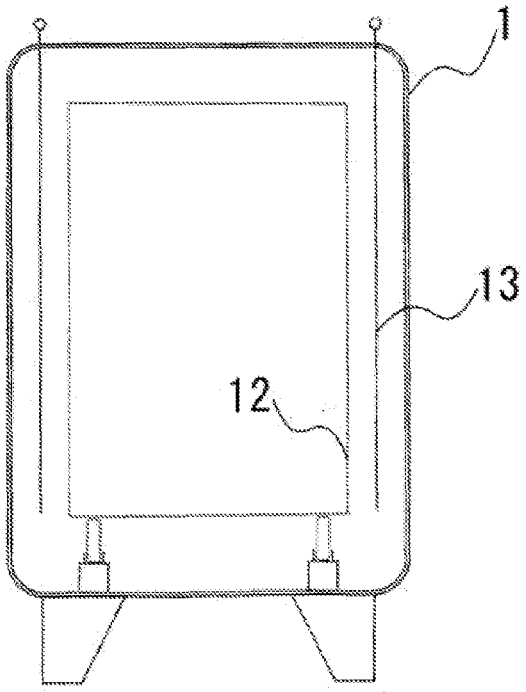
FIG. 4 is a left side view of FIG. 3.
Figure 5:
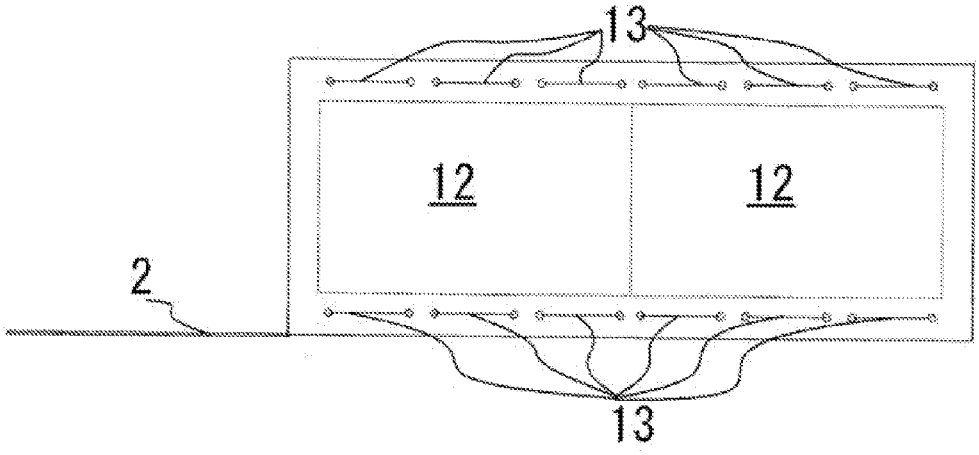
FIG. 5 is a plan view of FIG. 3.

FIG. 1 is a schematic explanatory view showing a reduced pressure tank, a vacuum pump, and temperature and pressure control sections. FIG. 3 is a front view showing an inner sidewall of the reduced pressure tank, and a container carrier. FIG. 4 shows a left side view of FIG. 3, and FIG. 5 shows a plan view of FIG. 3, respectively.

1 is a reduced pressure tank, 2 is a reduced pressure tank door, 3 is a thermometer which measures a temperature in the reduced pressure tank 1, 4 is a temperature controller which controls the temperature in the reduced pressure tank 1, 5 is a pressure gauge which measures a pressure in the reduced pressure tank 1, and 6 is a pressure controller which controls the pressure in the reduced pressure tank 1, respectively. 9 is a vacuum pump which performs pressure reduction in the reduced pressure tank 1, and the vacuum pump is connected via a pressure regulating valve 8 attached to a pipe.

Figure 6:
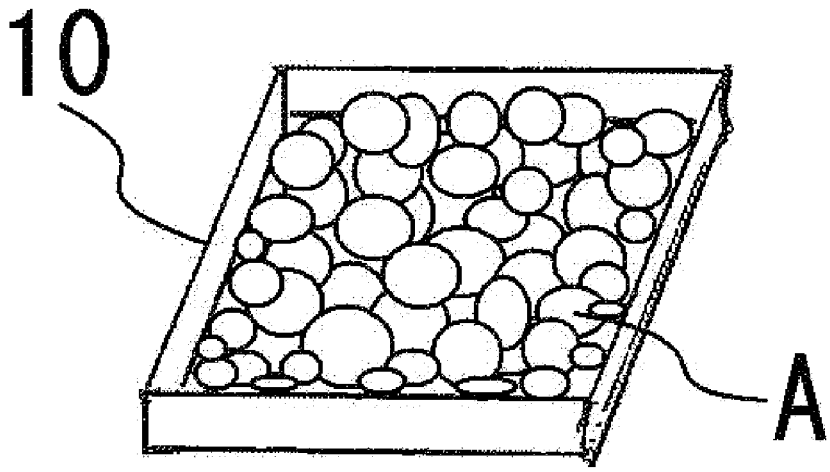
FIG. 6 is a schematic perspective view of a container in which objects to be dried are mounted.
Figure 7:
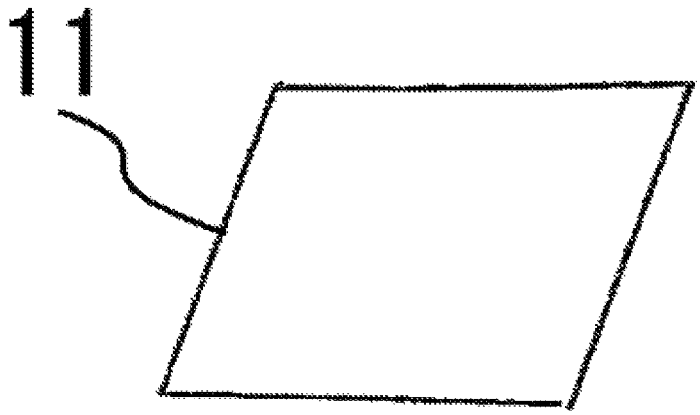
FIG. 7 is a schematic explanatory view showing a lid of the container in which the objects to be dried are mounted.

An absorption power of radiant heat from a far infrared heater 13 and a thermal conductivity are high, respectively, in a container 10. As shown in FIG. 6, the container is formed of an aluminum plate, a stainless steel plate or the like, which is a material having a high absorption power of the radiant heat and a high thermal conductivity. The surface of the container is formed of a fluoric resin or a silicon resin in black or a color close to the black by baking-finish. The black color has a suitable absorption power of the radiant heat of far infrared rays. Moreover, an inner surface of the container 10 which is coated with fluorine is hygienically suitable even when the surface comes in contact with objects A to be dried which are foods such as vegetables or fishes.

In the present embodiment, the container 10 has a rectangular shape in planar view, but is not limited to this shape, and may have a shape such as an elliptic or circular shape in planar view. That is, the containers may have any shape as long as the containers can efficiently be stored in a limited storage space of the reduced pressure tank 1.

Both sidewall surfaces of the reduced pressure tank 1 are provided with reflective plates (not shown), when a thermal efficiency is taken into consideration in a case where the far infrared heater 13 is disposed. For the purpose of efficiently and uniformly applying the radiant heat to the containers 10 in which the objects A to be dried are mounted, the far infrared heater 13 is attached so that the heater vertically extends downwardly from a ceiling of the tank to a bottom surface of the tank, has a lower portion thereof bent in a U-shape, again vertically extends upwardly toward the ceiling, and has an upper portion thereof bent downwardly in the U-shape around the ceiling. Subsequently, this arrangement is repeated from the door 2 side toward an inner wall surface of the reduced pressure tank 1. FIG. 3 and FIG. 5 show a state where two container carriers 12 are stored.

Figure 9:
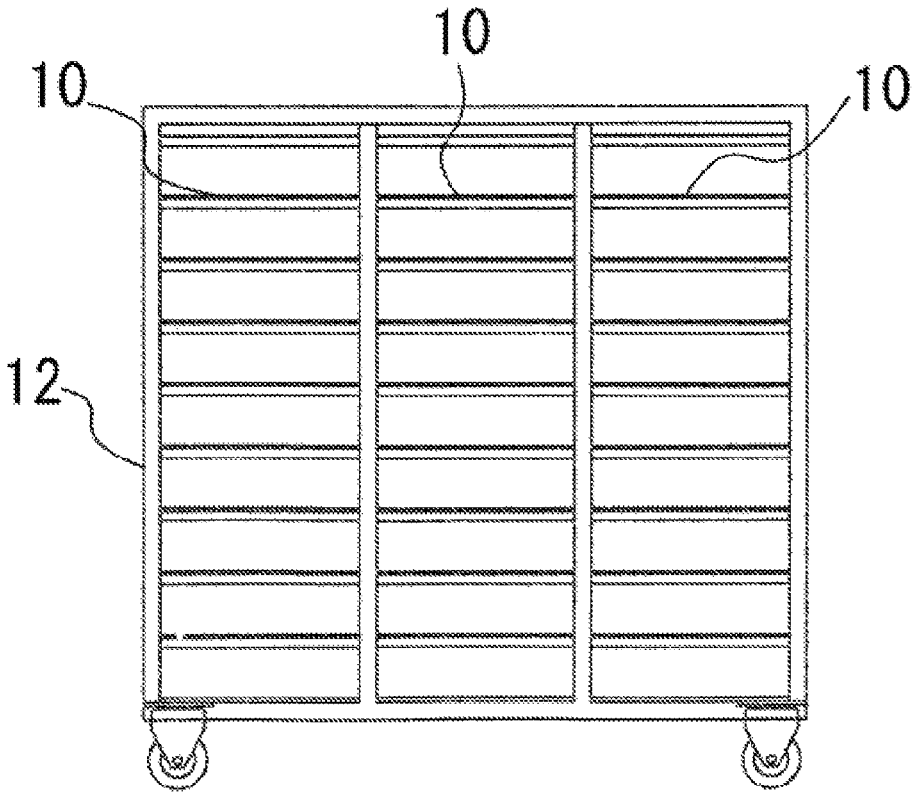
FIG. 9 is a front view showing an inner state of the reduced pressure tank in which three container carriers are stored.
Figure 10:
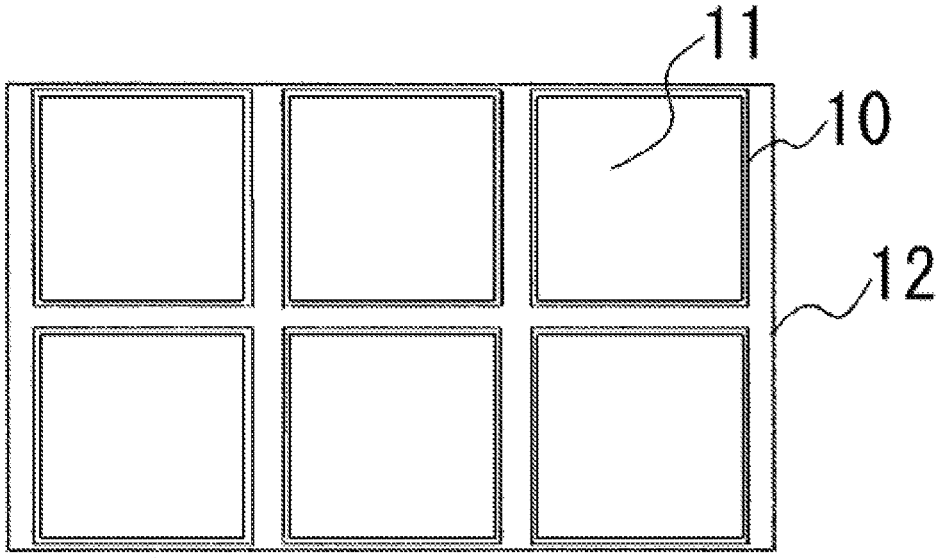
FIG. 10 is a schematic plan view of FIG. 9.

FIG. 9 and FIG. 10 show a case where three container carriers 12 are stored in the reduced pressure tank 1.

Figure 8:
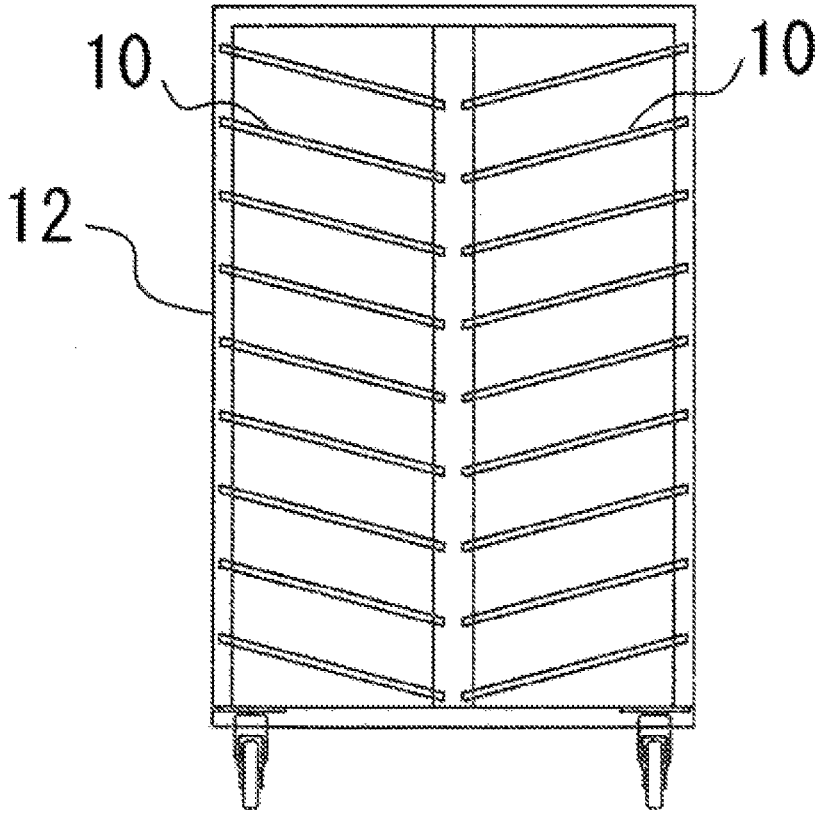
FIG. 8 is a side view showing a state where the containers are tilted and stored via an equal space from right and left sides in the container carrier.

The containers 10 to be stored in the container carriers 12 are tilted and stored so that as shown in FIG. 8, the containers 10 are lowered from right and left sides toward a center via an equal space.

In the present embodiment, when the rectangular containers 10 each having a longitudinal size of 450 mm, a lateral size of 450 mm and a height of 30 mm are used, each of lids 11 has a longitudinal size of 448 mm, a lateral size of 44 mm and a plate thickness of 1 mm. In this case, the objects A to be dried are mounted in the containers 10, and the containers provided with the lids 11 are then stored on tilted surfaces of nine stages of each of the container carriers 12, respectively, each of the tilted surfaces having a tilt angle of ten degrees. In the present embodiment, each space between the stages is kept at 148 mm. The respective containers 10 are tilted in this manner, so that any portion of the containers 10 can uniformly be irradiated with the radiant heat of the far infrared rays. The tilt angle of each of the containers 10 is suitably set to an optimum tilt angle in accordance with the sizes, a depth and the like of the container, and a vertical space between the containers 10 is also suitably determined in accordance with the sizes and the like of each container. FIG. 9 and FIG. 10 show a case where nine stages×six containers, i.e., the 54 containers 10 are inserted and mounted in the one container carrier 12. Moreover, the tilt angles of the containers 10 are not limited to the same tilt angle, as long as the objects A to be dried are evenly irradiated with the radiant heat from the far infrared heater 13.

In the freeze-drying apparatus according to the present invention, shelves forming the plurality of stages on which sets of the metal containers 10 containing the mounted objects A to be dried and the lids 11 for the containers are mounted are made of stainless steel, a space between the stages of the shelves is 80 mm or more, and each of the stages includes a frame which is provided with a gradient of ten degrees or more and which supports the containers containing the mounted objects to be dried.

Next, a freeze-drying apparatus by the far infrared heater 13 of the present invention is a heating apparatus of the objects A to be dried in freeze-drying. The apparatus includes means for mounting the frozen objects to be dried prior to heating in the containers 10 in which an absorption power of the radiant heat from the far infrared heater 13 and a thermal conductivity are high, respectively; a step of mounting the frozen objects A to be dried which are contained in the containers 10 or unfrozen objects to be dried into the reduced pressure tank under an atmospheric pressure; a step of freezing the objects to be dried by use of evaporation latent heat of evaporation of water contents of the objects to be dried themselves while advancing pressure reduction, when the unfrozen objects to be dried are mounted; and a step of heating the containers 10 by the radiant heat from the far infrared heater 13 disposed in the reduced pressure tank 1 and sublimating the frozen water contents of the objects to be dried in a reduced pressure state where sublimation of the objects A to be dried occurs in the reduced pressure tank 1.

Example 1

A conventional freeze-drying apparatus was used, 2 kg of corns were mounted in one container, and 16 containers 10 in total were mounted to perform drying. On the other hand, 2 kg of corns were similarly mounted in one container (without any lids) according to the present invention, and 16 containers 10 were mounted to perform the drying. In the conventional freeze-drying, 30 hours were required for the drying. On the other hand, in the freeze-drying according to the present invention, only 15 hours were required.

Example 2

Similarly to Example 1, 2 kg of corns were mounted in one container (provided with a drop-lid-like lid) according to the present invention, and 16 containers 10 in total were mounted to perform comparison of drying time. In the freeze-drying according to the present invention, only ten hours were required. An average moisture content of dried objects was 6.0% by conventional freeze-drying, and the moisture content was 3.5% by the freeze-drying according to the present invention.

Example 3

Steamed scallop eyes were dried. An average thickness of these scallop eyes was about 25 mm 5 kg of conventional steamed scallop eyes were mounted. In conventional freeze-drying, even when 30 hours were spent, centers of the scallop eyes were not completely dried. On the other hand, in freeze-drying according to the present invention, a lid 11 was set, the drying was performed, and then completely dried objects were obtained in ten hours. An average moisture content of the dried objects was 3%.

Example 4

Boiled Japanese radishes were dried. A thickness of each of the radishes was set to 35 mm, and 10 kg of the radishes were mounted. In conventional freeze-drying, it was not possible to dry centers of the radishes even after elapse of 36 hours. In freeze-drying according to the present invention in which a lid 11 was set to a container 10, completely dried objects were obtained in 14 hours. Average moisture content of the dried objects was 3.5%.

Example 5

Soybean paste was dried. 10 kg of commercially available soybean paste was used. A mounting thickness in a container 10 was about 30 mm. In conventional freeze-drying, 28 hours were required, and an only portion of the soybean paste that came in contact with the container was discolored and deteriorated. Taste thereof was also deteriorated. Moreover, a thickness center of the soybean paste was not dried yet. In freeze-drying according to the present invention, a lid was disposed, and a heating temperature of a dummy sensor was set to 40° C., to perform drying. In this case, the drying was terminated in eight hours, and discoloration or taste deterioration was not recognized. When the soybean paste was ground into powder, the soybean paste powder which had high storage properties and whose taste compared favorably with the paste was obtained. A paste raw material or the like in a pharmaceutical field or a cosmetic field can be dried similarly to this example.

Example 6

A solution of aloe vera was dried. The solution had moisture content of 99.5%. First, the solution was frozen in a refrigerator. 3 kg of the solution was mounted in one container, and 16 containers in total were mounted in a reduced pressure tank. In conventional freeze-drying, complete drying was not achieved even after elapse of 48 hours. On the other hand, in freeze-drying according to the present invention, lids were set to containers after the freezing, to perform drying. To avoid breakdown of enzyme of the aloe vera, a heating temperature of the containers with the lids by a far infrared heater was set to 38° C. to perform the drying. In this case, complete drying was achieved in 18 hours.

The present invention can provide a freeze-drying apparatus having a low price and an excellent performance, and hence a demand for the apparatus spreads in districts having objects to be dried all over the world. Moreover, a thickness of each of the objects to be dried which can be frozen and dried is increased to be twice or more as compared with a conventional technology, and hence the present invention can contribute to a broad range of product development. In a conventional freeze-drying apparatus, an apparatus price is so high that it has been difficult to utilize the apparatus in developing countries. However, the apparatus of the present invention can be increasingly utilized in many districts of the world, and can contribute to economic development of each district, owing to a production time (the production amount), inexpensiveness, and simple maintenance properties of the apparatus.

DESCRIPTION OF REFERENCE MARKS

1 reduced pressure tank
2 reduced pressure tank door
3 thermometer
4 temperature controller
5 pressure gauge
6 pressure controller
7 cold trap
8 pressure regulating valve
9 vacuum pump

10 container in which objects to be dried are mounted
11 lid
12 container carrier
13 far infrared heater
14 heating temperature detector
15 pressure detector

The invention claimed is:

1. A freeze-drying apparatus is characterized in that the said freeze-drying apparatus includes a reduced pressure tank in which a far infrared heater is disposed along a sidewall, or the sidewall and a ceiling; a container carrier which conveys a plurality of containers to contain mounted objects to be dried into the reduced pressure tank, and supports the containers in a drying step; the containers having a high absorption power of radiant heat and mounted via a space in multistage of the container carrier; the frozen objects to be dried which are contained in the containers; a tray support member of the container carrier in which the respective containers containing the frozen objects to be dried are vertically arranged via the space on multistage so that the containers are evenly irradiated with heat radiated from the far infrared heater and in which the containers mounted on the respective stages are tilted at the same angle or at such angles that the containers are evenly irradiated with the radiated heat; and inside the reduced pressure tank, a control section including a heating temperature detecting section and a pressure detecting section is arranged in order to sublimate the objects to be dried in the reduced pressure state where the sublimation of the objects to be dried occurs in the reduced pressure tank; and outside the reduced pressure tank, a heating temperature control section of the far infrared heater to the containers and a pressure control section which controls the pressure inside the tank are arranged.

2. The freeze-drying apparatus according to claim 1 is characterized in that respective outer surfaces of the containers which are made of a metal and in which the objects to be dried are mounted or respective outer surfaces of containers with drop lids as the containers with the lids which keep atmosphere in the reduced pressure tank are baking-finished with a fluoric resin or a silicon resin in black or a color close to the black.

3. The freeze-drying apparatus according to claim 1 characterized in that a metal material of the metal containers in which the objects to be dried are mounted and the lids for the containers is an aluminum plate or a stainless steel plate.

4. The freeze-drying apparatus according to claim 1, characterized in that shelves forming the plurality of stages on which sets of the metal containers to contain the mounted objects to be dried and the lids for the containers are mounted are made of stainless steel, the shelves of the stages are arranged via a space of 80 mm or more, and each of the stages includes a frame which is provided with a gradient of 10 degrees or more and which supports the containers containing the mounted objects to be dried.

5. The freeze-drying apparatus according to claim 1, characterized in that inside the reduced pressure tank, the far infrared heater is disposed along the sidewall, or the sidewall and the ceiling, a temperature detector finished in the same black or the same color close to the black as a color of each of the metal containers to contain the mounted objects to be dried is disposed in a portion corresponding to a distance between the far infrared heater and the vicinity of the center of each of the containers to contain the mounted objects to be dried, and means for detecting a heating temperature by the far infrared heater to the outer surface of each of the containers containing the mounted objects to be dried is disposed; further, inside the reduced pressure tank, a pressure detecting means including a pressure sensor is disposed in order to detect a pressure value in the tank; and outside the reduced pressure tank, a temperature controller of the far infrared heater, a pressure gauge, a pressure regulating valve, a pressure controller, a return pressure valve and a vacuum pump are arranged, connecting to one another via a metal pipe or a resin pipe.

* * * * *